US009267705B2

(12) United States Patent
Walker

(10) Patent No.: US 9,267,705 B2
(45) Date of Patent: Feb. 23, 2016

(54) MEMBRANE SEAL FOR WATER HEATER TANK SPUDS

(71) Applicant: A. O. Smith Corporation, Milwaukee, WI (US)

(72) Inventor: Arthur Eugene Walker, Columbia, TN (US)

(73) Assignee: A. O. SMITH CORPORATION, Milwaukee, WI (US)

( * ) Notice: Subject to any disclaimer, the term of this patent is extended or adjusted under 35 U.S.C. 154(b) by 329 days.

(21) Appl. No.: 13/785,151

(22) Filed: Mar. 5, 2013

(65) Prior Publication Data

US 2014/0250670 A1 Sep. 11, 2014

(51) Int. Cl.
*F24H 9/12* (2006.01)
*F24H 1/20* (2006.01)

(52) U.S. Cl.
CPC ..... *F24H 9/124* (2013.01); *F24H 1/205* (2013.01); *Y10T 29/49948* (2015.01)

(58) Field of Classification Search
CPC .... Y10T 29/49387; F24H 9/124; F24H 1/205
See application file for complete search history.

(56) References Cited

U.S. PATENT DOCUMENTS

| | | | | |
|---|---|---|---|---|
| 2,092,757 | A * | 9/1937 | Groeniger | 137/218 |
| 3,647,109 | A | 3/1972 | Hebblethwaite | |
| 3,843,011 | A | 10/1974 | Perry | |
| 4,850,503 | A | 7/1989 | Larsson | |
| 4,915,254 | A | 4/1990 | Zumsteg | |
| 4,964,394 | A * | 10/1990 | Threatt | 122/14.31 |
| 5,052,347 | A | 10/1991 | Nelson | |
| 5,158,200 | A | 10/1992 | Vago et al. | |
| 5,217,140 | A | 6/1993 | Lindahl | |
| 5,431,296 | A | 7/1995 | Lewis | |
| 5,568,687 | A | 10/1996 | Syler et al. | |
| 5,655,299 | A | 8/1997 | Lindahl | |
| 7,137,965 | B2 | 11/2006 | Fischer et al. | |
| 7,373,959 | B2 | 5/2008 | Edwards et al. | |
| 2003/0051343 | A1 | 3/2003 | Ball | |
| 2007/0284371 | A1 | 12/2007 | Anderson et al. | |
| 2010/0269345 | A1 | 10/2010 | DeArmey | |

* cited by examiner

*Primary Examiner* — Richard Chang
(74) *Attorney, Agent, or Firm* — Michael Best & Friedrich LLP

(57) ABSTRACT

A method of manufacturing a water heater includes providing a water heater tank having an interior and an exterior and a tank aperture communicating between the interior and exterior. A spud that defines a spud aperture extending from a first end to a second end is provided. The spud aperture is internally threaded and has a counterbore adjacent the second end. A membrane having a membrane body and a plurality of tabs extending outwardly from the membrane body is provided. The membrane is seated within the counterbore such that the tabs deform and engage a surface of the counterbore to hold the membrane in the counterbore. Thereafter, the second end of the spud is welded to the tank, such that the membrane is captured between the spud and the tank and communication between the tank aperture and the internally threaded portion of the spud aperture is obstructed by the membrane.

20 Claims, 6 Drawing Sheets

MEMBRANE SEAL FOR WATER HEATER TANK SPUDS

BACKGROUND

The present invention relates to a water heater and a method of manufacturing the water heater.

SUMMARY

In one embodiment, the invention provides a method of manufacturing a water heater. A water heater tank having an interior and an exterior and a tank aperture communicating between the interior and exterior is provided. A spud that defines a spud aperture extending from a first end to a second end is provided. The spud aperture is internally threaded and has a counterbore adjacent the second end. A membrane having a membrane body and a plurality of tabs extending outwardly from the membrane body is provided. The membrane is seated within the counterbore such that the tabs deform and engage a surface of the counterbore to hold the membrane in the counterbore. Thereafter, the second end of the spud is welded to the tank, such that the membrane is captured between the spud and the tank and communication between the tank aperture and the internally threaded portion of the spud aperture is obstructed by the membrane.

In another embodiment, the invention provides a method of manufacturing a water heater. A water heater tank having an interior and an exterior and a tank aperture communicating between the interior and exterior is provided. A spud that defines a spud aperture extends from a first end to a second end is provided. The spud aperture is internally threaded and has a counterbore adjacent the second end. A membrane having a membrane body and a plurality of tabs extending outwardly from the membrane body is provided. The membrane body defines a knockout portion. The membrane is seated within the counterbore, such that the tabs deform and engage a surface of the counterbore. Thereafter, the second end of the spud is welded to the tank, such that the membrane is captured between the spud and the tank and communication between the tank aperture and the internally threaded portion of the spud aperture is obstructed by the membrane. Thereafter, unfired glass is sprayed to the interior of the tank. Thereafter, heat is applied to the unfired glass. Thereafter, the interior of the tank is pressure tested. Thereafter, the knockout portion is removed to form a membrane aperture in the membrane body so that the internally threaded portion of the spud aperture communicates with the interior of the tank via the tank aperture.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
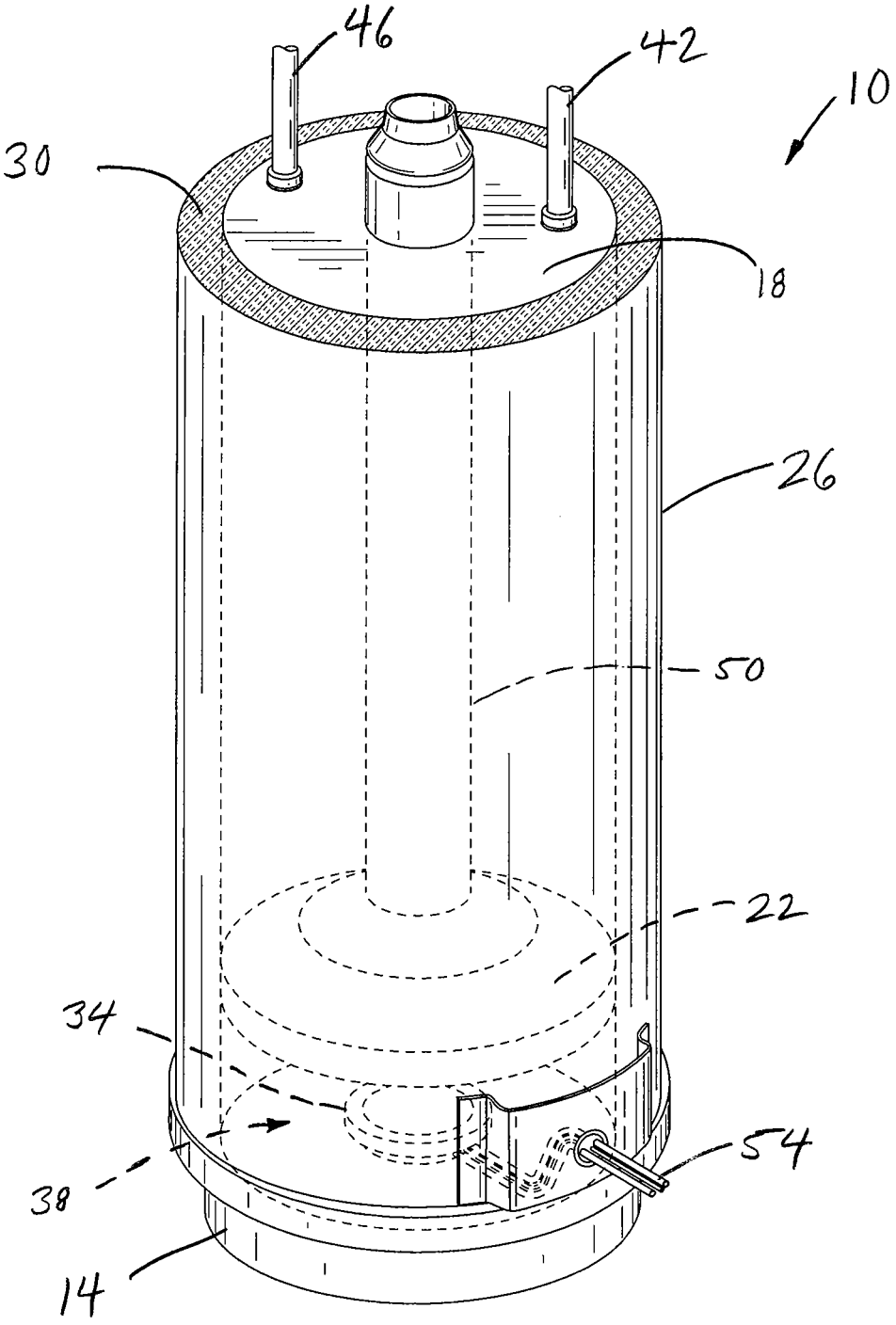
FIG. 1 is a perspective view of a water heater embodying the invention.

FIG. 1 illustrates a water heater 10 according to one embodiment of the present invention. Particularly, FIG. 1 illustrates the water heater 10 including a base pan 14, a metal water tank 18 with a bottom head 22, an insulating jacket 26 surrounding the tank 18, and insulating material 30 between the tank 18 and jacket 26. As illustrated in FIG. 1, a top portion of the jacket 26 is cut away to show the insulating material 30. The water heater 10 also includes a burner 34 disposed in a combustion chamber 38 beneath the bottom head 22 of the tank 20, a water inlet pipe 42, a water outlet pipe 46, and a flue tube 50 extending from the combustion chamber 38 and through the tank 18. During operation of the water heater 10, gas fuel is provided to the burner 34 through a conduit 54. Products of combustion or hot gasses flow up from the combustion chamber 38 and through the flue tube 50 to heat the water in the tank 18. Other constructions of the water heater also fall within the scope of the invention.

Figure 2:
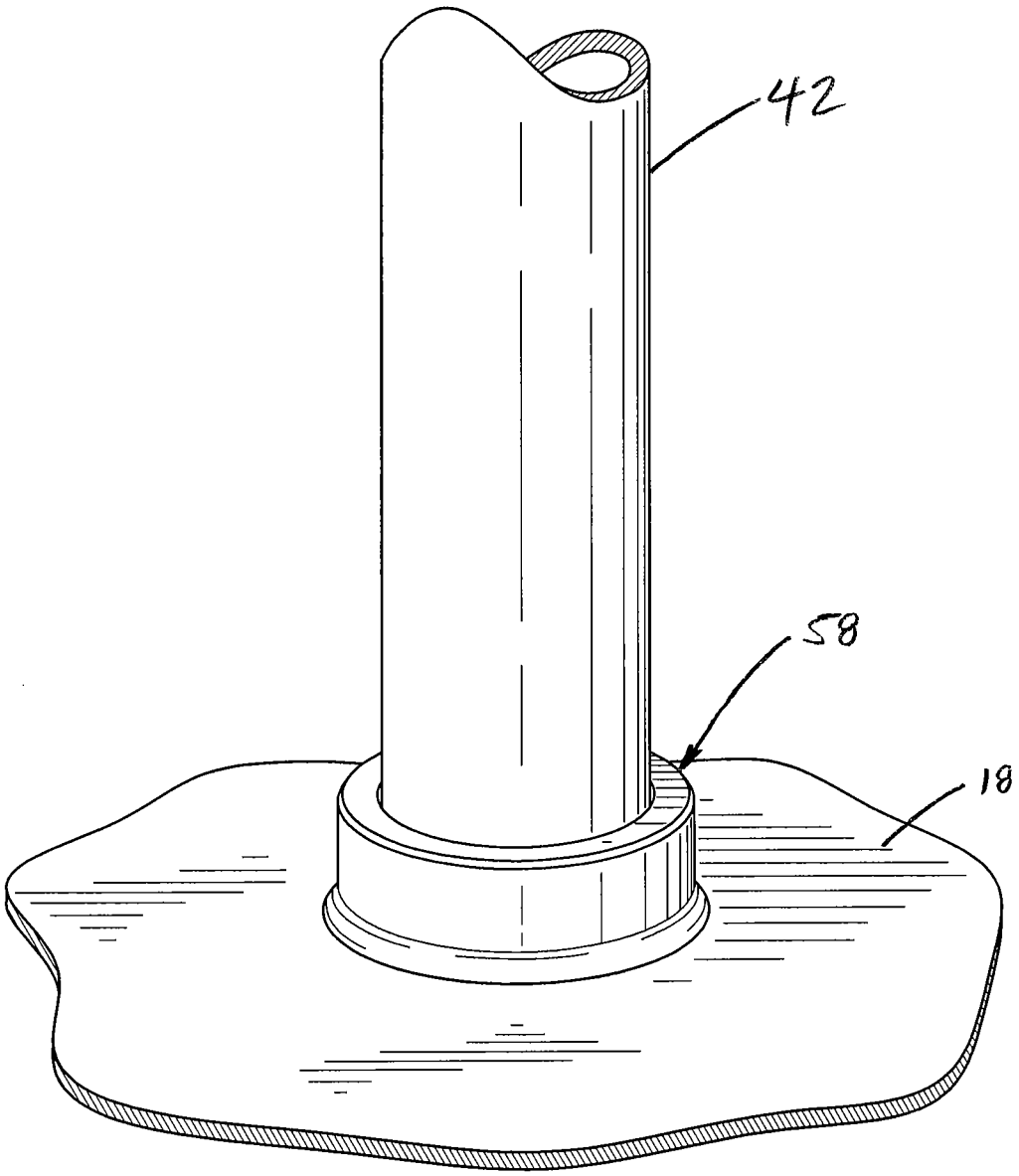
FIG. 2 is an enlarged portion of the water heater in FIG. 1.

FIG. 2 illustrates a detailed portion of the water heater 10. Particularly, FIG. 2 illustrates a connection 58 between the inlet pipe 42 and the tank 18 according to one embodiment of the present invention. In the illustrated construction, the connection 58 is the same as a connection between outlet pipe 46 and the tank 18, thus the following description applies to both connections between either inlet pipe 42 or outlet pipe 46 and the tank 18.

Figure 3:
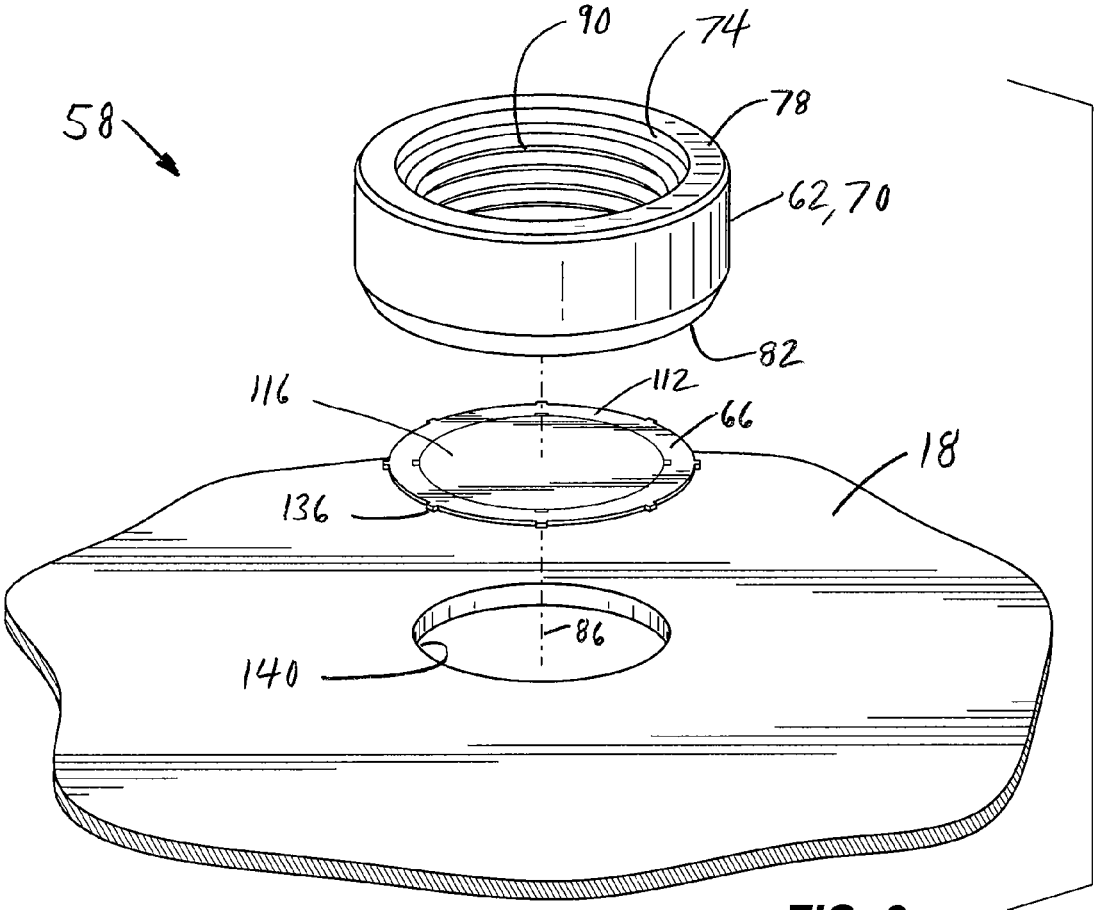
FIG. 3 is an exploded view of a spud, a membrane and a portion of the tank in FIG. 2 prior to a welding process.
Figure 5A:
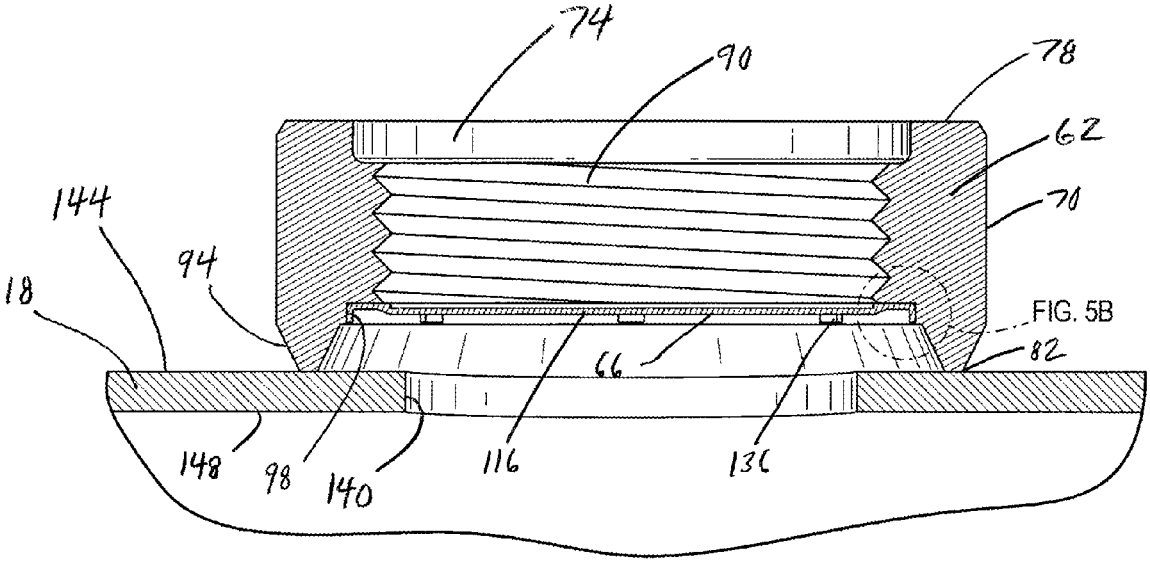
FIG. 5A is a section view of the spud, membrane and portion of the tank in FIG. 2 in position for the welding process.

FIG. 3 is an exploded view of the connection 58. The connection 58 includes a spud 62 and a membrane 66. The spud 62 has a cylindrical body 70 with a spud aperture 74 extending from a first or upper end 78 to a second or lower end 82 along a spud axis 86. Referring to FIGS. 3 and 5A, the aperture 74 defines internal screw threads 90 between the ends 78 and 82, for threaded engagement with external screw threads of the inlet pipe 42 (or outlet pipe 46).

Figure 5B:
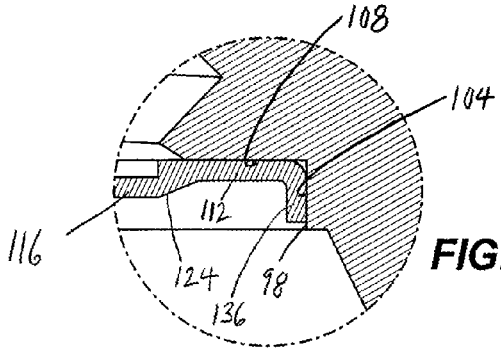
FIG. 5B is an enlarged portion of FIG. 5A.

Referring to FIG. 5A, the lower end 82 of the spud 62 includes a beveled weld extension 94. A counterbore 98 is defined within the spud 62, adjacent the lower end 82 and between the weld extension 94 and the internal screw threads 90. Referring to FIG. 5B, the counter bore 98 defines a cylindrical bore surface 104 centered on the spud axis 86 (FIG. 5C) and an annular base surface 108 oriented perpendicular to the axis 86. In the illustrated construction, the spud 62 is manufactured of a metal material, such as, for example, an alloy steel that is appropriate for welding the spud to the tank.

Figure 4A:
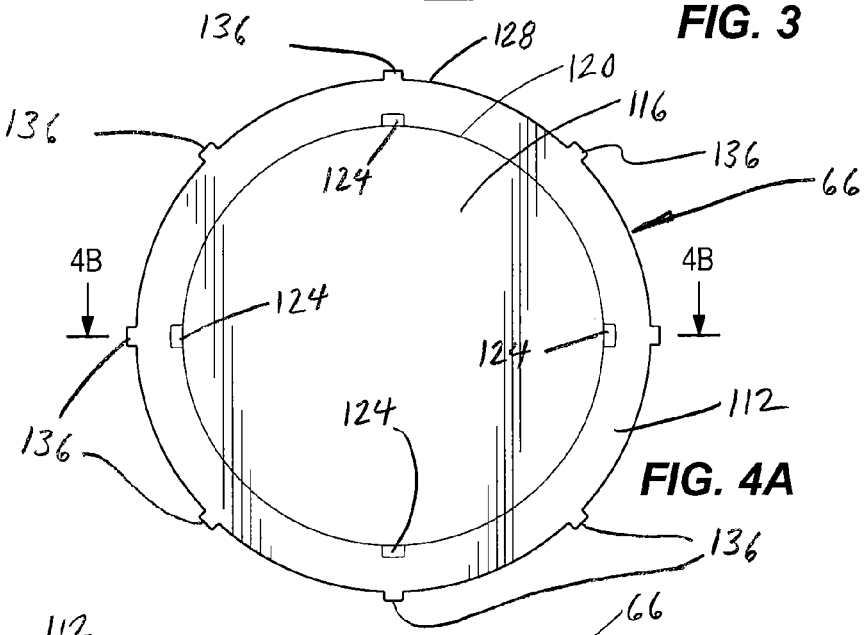
FIG. 4A is a top view of the membrane of FIG. 3.
Figure 4B:
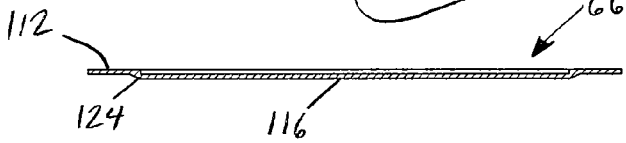
FIG. 4B is a cross sectional view of the membrane along section 4B-4B.

Referring to FIG. 4A, the membrane 66 includes an annular body portion 112, and a wafer-like knockout portion 116. An annular weakened region 120 of the membrane 66 defines a boundary between the annular body portion 112 and the knockout portion 116. The weakened region 120 may be formed, for example, by punching the membrane 66 with a die. The weakened region 120 is interrupted by knockout tabs or lances 124. As shown in FIG. 4B, the lances 124 maintain a constant material thickness when transitioning from the annular body portion to the knockout portion. The lances 124 thereby retain the knockout portion 116 within the annular body portion 112, in the event that the weakened region 120 is punched too deeply and the die penetrates completely through the membrane 66. However, the lances 124 may be readily broken when a user intentionally knocks out the knock-out portion.

Figure 5C:
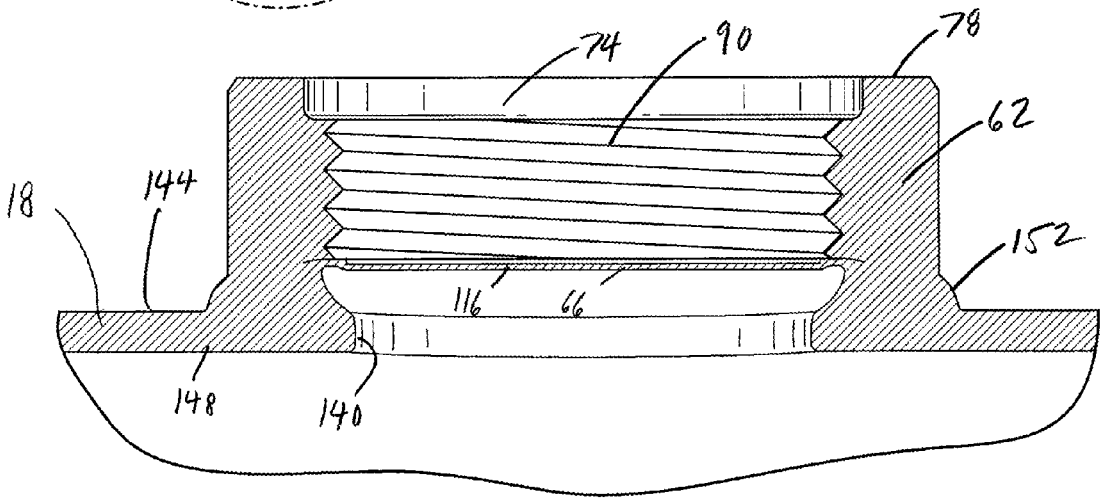
FIG. 5C is a section view of the spud, membrane and portion of the tank subsequent to the welding process.
Figure 5D:
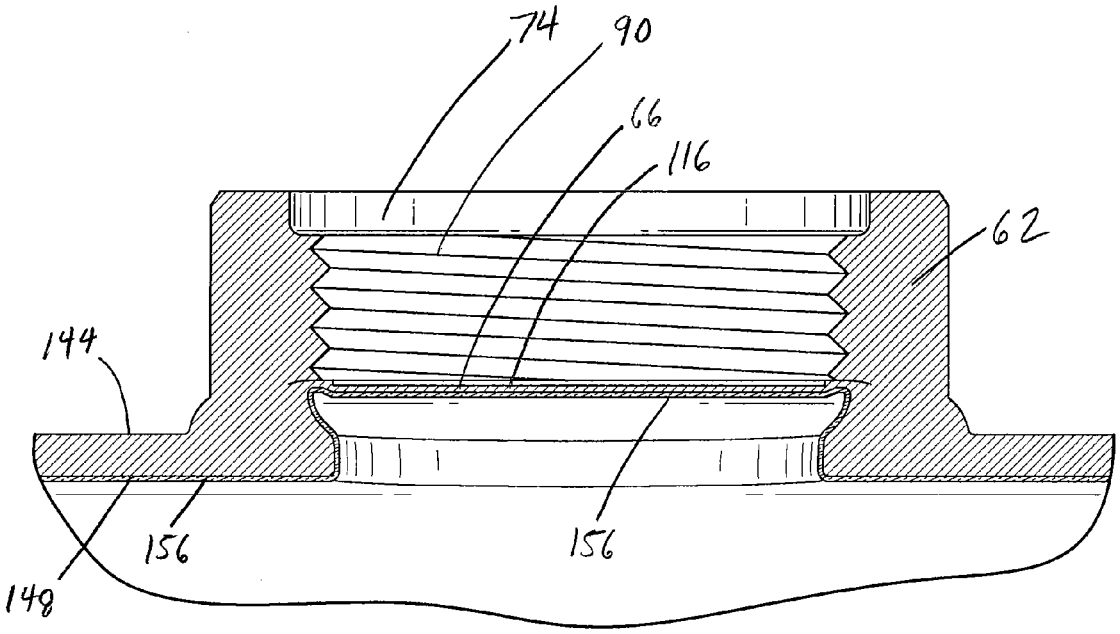
FIG. 5D illustrates the elements in FIG. 5C plus a coating on the interior of the tank.
Figure 5E:
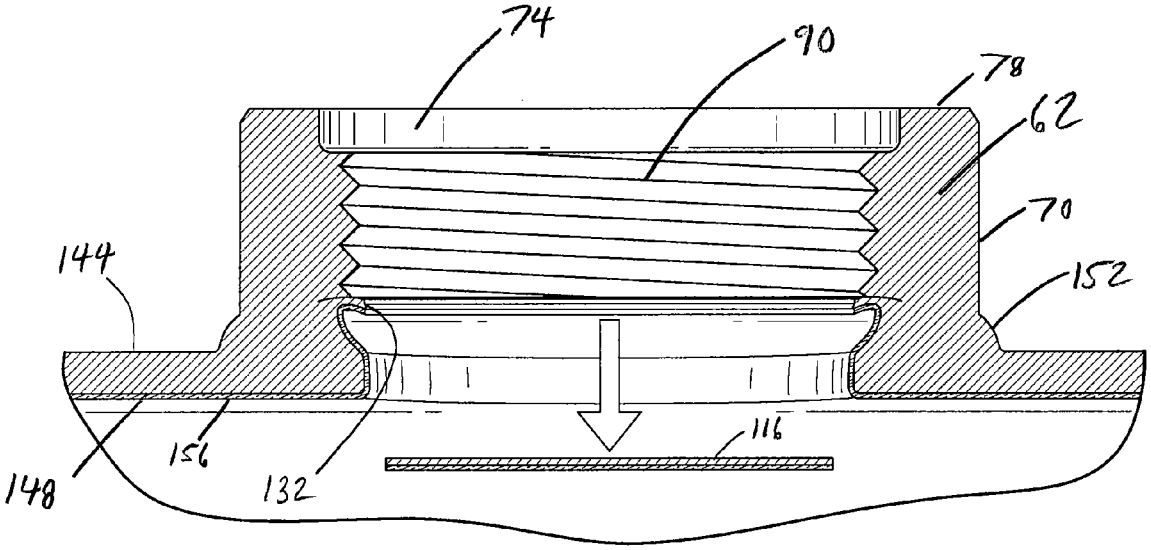
FIG. 5E is a perspective view of the elements in FIG. 5D with a portion of the membrane removed.

The annular body portion 112 defines an outer radial edge 128 and, when the knockout portion 116 is removed, a membrane aperture 132 (FIG. 5E). Referring to FIG. 4A, deformable tabs 136 extend radially from the outer radial edge 132. Referring to FIG. 5B, the tabs 136 are configured to deformably engage the bore surface 104 of the spud 62. When the membrane 66 is positioned within the counterbore 98, the tabs 136 are deformed from their substantially radial orientation (FIGS. 3 and 4A) to a substantially non-radial orientation (FIG. 5B), relative to the outer radial edge 128. The tabs 136 engage with the bore surface 104 such that, with the annular body portion 112 seated on the base surface 108, the membrane 66 is retained within the counterbore of the spud until welding is complete.

In the illustrated construction, the membrane 66 may be manufactured of a metal material, such as, for example, an alloy steel that may be welded to the tank 18 and spud 62.

FIGS. 3 and 5A-5E help illustrate the steps of a manufacturing process of the water heater 10 according to one embodiment of the present invention. With reference to FIG. 3, the manufacturing process includes providing the tank 18, the spud 62 and the membrane 66 to form one connection 58 (as illustrated in FIG. 2). In the illustrated construction, the membrane 66 is seated within the counterbore 98 of the spud 60 (as in FIGS. 5A and 5B). The spud 62 and membrane 66 are then positioned over a portion of the tank 18 defining a tank aperture 140. The tank aperture 140 extends through the tank 18 from an exterior surface 144 to an interior surface 148 of the tank 18 (FIG. 5A). The spud 62 and membrane 66 are aligned with respect to the tank aperture 140 such that the spud axis 86 extends through the center of the tank aperture 140 (FIG. 3). Moreover, and referring to FIG. 5A, the knockout portion 116 of the membrane 66 is aligned with the larger diameter tank aperture 140, such that the knockout portion 116 can subsequently be knocked free, into the interior of the tank 18, as in FIG. 5E.

The manufacturing process also includes welding the spud 62 and membrane 66 to the tank 18, as illustrated in FIG. 5C. As a result of the welding process, the welding extension 94 of the spud 62, the annular body portion 112 of the membrane 66, and a portion of the tank 18 surrounding the tank aperture 140 form an annular welding nugget 152. With the membrane 66 and spud 62 welded in place, fluid communication between the spud 62 and the interior of the tank 18 (as defined by the interior surface 148) is obstructed by the knockout portion 116 of the membrane. In a preferred embodiment, the tank 18, spud 62 and membrane 66 are manufactured of the same or similar metal materials, such as a steel alloy. However, the invention provides for the tank 18, spud 62 and membrane 66 to include materials other than metals to facilitate other types of welding processes (e.g., ultrasonic welding).

Referring to FIG. 5D, subsequent to the welding process, the manufacturing process includes applying a coating 156 to the interior surface 148 of the tank 18 to help prevent the tank 18 from rusting, as is known in the art. In one preferred construction, applying the coating 156 to the inner surface 148 of the tank 18 includes spraying unfired glass on the interior of the tank 20. In other constructions, applying the coating 156 to the interior of the tank 18 includes applying a coating of porcelain, ceramic, polymer, organic material, electroplating or other materials suitable to prevent the surface of the tank 18 from rusting. In the manufacturing process of the water heater 10, it is desirable to prevent materials forming the coating 156 to come into contact with or settle on the threaded portion 90 of the spud 62. Because the membrane 66 obstructs communication between the tank aperture 140 and the threaded portion 90 of the spud 62, the membrane 66 helps prevent the coating material 156 from contacting the threaded surface 90 of the spud 62.

Optionally, the manufacturing process can include applying a dust coating to the exterior surface 144 of the tank 18. In applying the dust coating, part of the material being applied also coats or comes into contact with the threaded portion 90 of the spud 62. The dust coating forms a relatively thin layer in comparison to the coating 156 applied to the interior surface 148 of the tank 18. However, the dust coating is sufficient to help prevent oxidizing of the exterior surface 144 of the tank 18 and the membrane 66, as further explained below. Because the dust coating forms a relatively thin layer in comparison to the coating 156, there is no detriment to the manufacturing process if the dust coating is formed on the threaded portion 90 of the spud 62. In some constructions, the dust coating is formed of the same material as the coating 156. However, in other constructions, the dust coating includes other materials that permit forming a relatively thin layer on the surface of the tank 18 and also help prevent oxidizing the tank 18 and membrane 66 surfaces.

Once the coating 156 is applied to the interior surface 148 of the tank 18, the tank 18 is put through a heating process. As indicated above, one preferred construction includes spraying unfired glass to form coating 156 on the interior surface 148. In this construction, the heating process includes placing the tank 18 through a furnace and heating/firing the unfired glass coating 156 to about 1600 degrees Fahrenheit. Firing the glass coating 156 allows fusing the elements forming the coating (e.g., silica and metals) to the interior surface 148 of the tank 18. As a result, the coating 156 is firmly fused to the surface 148 to help prevent rusting of the tank 20 during manufacturing and normal use of the water heater 10. The membrane 66 welded to the spud 62 and tank 18 is formed to withstand such temperatures. In other constructions, the membrane characteristics (e.g., diameter, periphery shape, thickness, material) can be adjusted for other heating processes that include heating the tank 18 to different temperatures.

Depending on the characteristics (e.g., materials and/or thicknesses) of the tank 18, spud 62, and membrane 66, the heating process can cause oxidation of the surface of the tank 18 and portions of the spud 62 and membrane 66 not protected by coating 156. In such cases, the dust coating helps prevent oxidation of the tank 18, spud 62, and membrane 66, thus preserving the integrity of the tank 18, spud 62, and membrane 66 during subsequent steps of the manufacturing process of the water heater 10.

The manufacturing process also includes pressure testing the tank 18 for detection of leaks or structural damage to the tank 18. In one process, the tank 18 is pressurized to about 35 pounds per square inch (psi). The membrane 66 welded to the spud 62 and tank 18 is formed to withstand such pressure, allowing proper testing of the tank 18. In other constructions, the membrane characteristics (e.g., diameter, periphery shape, thickness, material) can be adjusted to test the tank 18 at different pressures. In one preferred embodiment, the membrane 66 welded to the tank 18 substantially inhibits leaks or flow of fluid (e.g., pressurized air) therethrough. However, in other constructions the membrane 66 can include one or more relatively small apertures or a permeable material allowing fluid to flow therethrough. It is to be understood that for the purposes of pressure testing the tank 18, such characteristics of the membrane 66 are taken into consideration and are not detrimental to the testing process or manufacturing process in general of the water heater 10.

The heating process and pressure testing of the tank 18 can be done in a different order. For example, the tank 18 can be pressure tested prior to applying and firing the coating 156 to the surface 148 of the tank 18.

Once the tank 18 has gone through the heating process and has been pressure tested, the manufacturing process includes creating or forming the membrane aperture 132 through the membrane 66 to allow the flow of fluid (e.g., water) during operation of the water heater 10. With reference to FIG. 5E, the knockout portion 116 of the membrane 66 is removed by striking the knockout portion 116 with a tool (e.g., a punch), thereby separating the knockout portion 116 from the annular body portion 112. The knockout portion 116 passes through the tank aperture 140 and may remain within the interior of the tank. The annular body portion 112 remains attached to the spud 62 and tank 18.

Figure 6:
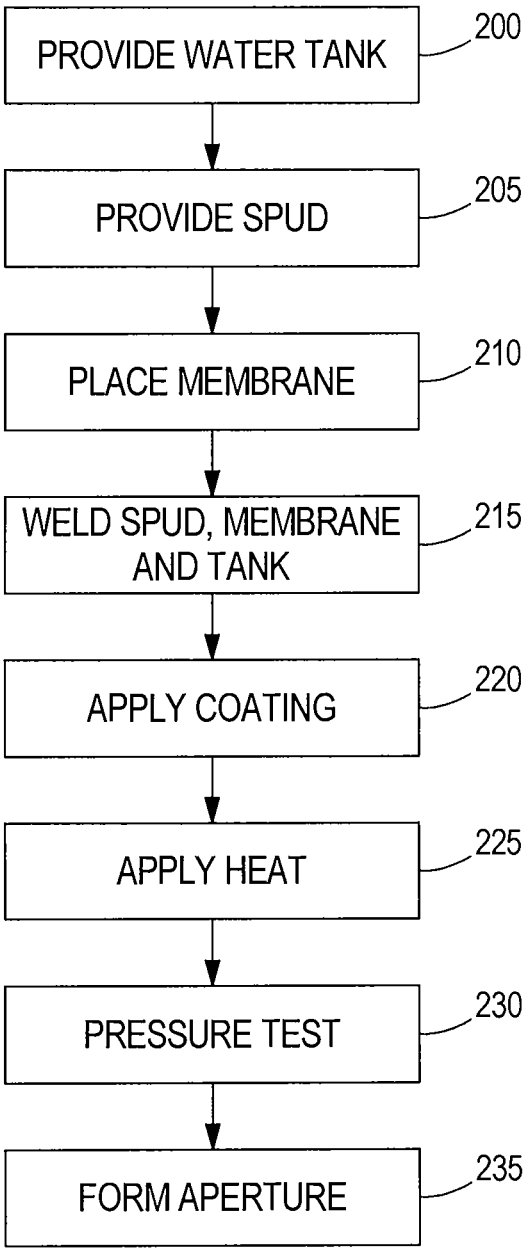
FIG. 6 is a flow diagram illustrating one method of manufacturing the water heater in FIG. 1.

FIG. 6 is a flow chart illustrating an exemplary process for manufacturing the water heater 10. It is to be understood that some of the steps comprised in the following process can occur in a different order. The process includes providing a water heater tank having an aperture communicating the interior and exterior of the tank (step 200), providing a spud with a threaded aperture (step 205) and placing a membrane between the spud and the tank such that the membrane covers the aperture of the tank (step 210). The process also includes welding the spud and the membrane to the tank (step 215), spraying a coating, such as unfired glass, to the interior of the tank (step 220) and applying heat to the coating (step 225). Finally, the process includes pressure testing the tank with the membrane covering the aperture of the tank (step 230) and forming an opening in the membrane for allowing fluid flow therethrough (step 235).

Various features and advantages of the invention are set forth in the following claims.

What is claimed is:

1. A method of manufacturing a water heater, the method comprising:

providing a water heater tank having an interior and an exterior, the tank also including a tank aperture communicating between the interior and exterior;

providing a spud, the spud defining a spud aperture extending from a first end to a second end, the spud aperture being internally threaded and having a counterbore adjacent the second end;

providing a membrane having a membrane body and a plurality of tabs extending outwardly from the membrane body;

seating the membrane within the counterbore such that the tabs deform and engage a surface of the counterbore to hold the membrane in the counterbore; and thereafter welding the second end of the spud to the tank, such that the membrane is captured between the spud and the tank and communication between the tank aperture and the internally threaded portion of the spud aperture is obstructed by the membrane.

2. The method of claim 1, wherein the act of seating the membrane within the counterbore includes plastically deforming the tabs when engaging the surface of the counterbore.

3. The method of claim 1, wherein the act of seating the membrane within the counterbore includes elastically deforming the tabs when engaging the surface of the counterbore.

4. The method of claim 1, wherein the act of seating the membrane within the counterbore includes seating the membrane body upon a base surface of the counterbore, and engaging the tabs with a bore surface of the counterbore.

5. The method of claim 1, further comprising:

thereafter forming a membrane aperture in the membrane body so that the internally threaded portion of the spud aperture communicates with the interior of the tank via the membrane aperture and the tank aperture.

6. The method of claim 5, wherein the forming the membrane aperture includes removing at least a portion of the membrane body.

7. The method of claim 5, wherein the forming the membrane aperture includes removing a knockout portion of the membrane body.

8. The method of claim 1, further comprising:

thereafter spraying unfired glass to the interior of the tank;

thereafter applying heat to the unfired glass;

thereafter pressure testing the interior of the tank; and thereafter forming a membrane aperture in the membrane body so that the internally threaded portion of the spud aperture communicates with the interior of the tank via the membrane aperture and the tank aperture.

9. The method of claim 1, wherein the tank aperture has a diameter and the membrane body has a diameter greater than the tank aperture diameter.

10. The method of claim 1, wherein the act of providing the membrane includes unitarily forming the membrane body and the plurality of tabs together as one piece.

11. The method of claim 1, wherein the act of providing the membrane includes defining a knockout portion in the membrane body.

12. The method of claim 11, further comprising thereafter removing the knockout portion to form a membrane aperture in the membrane body.

13. The method of claim 1, wherein the act of seating the membrane within the counterbore includes bending the tabs from a substantially radial orientation relative to the membrane body to a substantially non-radial orientation relative to the membrane body.

14. The method of claim 1, wherein the act of seating the membrane within the counterbore includes bending the tabs from a substantially radial orientation relative to the membrane body to a substantially perpendicular orientation relative to the membrane body.

15. The method of claim 1, wherein the act of welding the second end of the spud to the tank includes coaxially aligning the spud aperture with the tank aperture.

16. The method of claim 1, wherein the act of welding the second end of the spud to the tank includes welding the membrane to spud.

17. The method of claim 1, wherein the act of welding the second end of the spud to the tank includes welding the membrane to the spud and the tank.

18. A method of manufacturing a water heater, the method comprising:

providing a water heater tank having an interior and an exterior, the tank also including a tank aperture communicating between the interior and exterior;

providing a spud, the spud defining a spud aperture extending from a first end to a second end, the spud aperture being internally threaded and has a counterbore adjacent the second end;

providing a membrane having a membrane body and a plurality of tabs extending outwardly from the membrane body, the membrane body defining a knockout portion;

seating the membrane within the counterbore, such that the tabs deform and engage a surface of the counterbore;

thereafter welding the second end of the spud to the tank, such that the membrane is captured between the spud and the tank and communication between the tank aperture and the internally threaded portion of the spud aperture is obstructed by the membrane;

thereafter spraying unfired glass to the interior of the tank;

thereafter applying heat to the unfired glass;

thereafter pressure testing the interior of the tank; and thereafter removing the knockout portion to form a membrane aperture in the membrane body so that the internally threaded portion of the spud aperture communicates with the interior of the tank via the tank aperture.

19. The method of claim 18, wherein the act of welding the second end of the spud to the tank includes coaxially aligning the spud aperture with the tank aperture.

20. The method of claim 18, wherein the act of welding the second end of the spud to the tank includes welding the membrane to spud.

* * * * *